US007236153B1

(12) United States Patent
Nakamura

(10) Patent No.: US 7,236,153 B1
(45) Date of Patent: Jun. 26, 2007

(54) SIGNAL PRODUCTION CIRCUIT AND DISPLAY DEVICE USING THE SAME

(75) Inventor: Eiji Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1329 days.

(21) Appl. No.: 09/690,262

(22) Filed: Oct. 17, 2000

(30) Foreign Application Priority Data

Oct. 28, 1999 (JP) ..... 11-307611
Aug. 8, 2000 (JP) ..... 2000-240409

(51) Int. Cl.
*G09G 3/36* (2006.01)

(52) U.S. Cl. ..... 345/98

(58) Field of Classification Search ..... 345/98, 345/99, 100, 87, 90, 56; 710/71, 1, 58; 315/169.2; 398/446; 341/100, 101
See application file for complete search history.

(56) References Cited

U.S. PATENT DOCUMENTS 5,001,692 A * 3/1991 Farla et al. ..... 369/47.51
5,023,891 A * 6/1991 Johnson, III ..... 375/333
5,031,095 A * 7/1991 Hara et al. ..... 709/236
5,394,442 A * 2/1995 Lill ..... 375/369
5,557,272 A * 9/1996 Riggio, Jr. ..... 341/100
5,889,817 A * 3/1999 Yoshida ..... 375/220
5,920,261 A * 7/1999 Hughes et al. ..... 340/568.8
6,031,481 A * 2/2000 Craven ..... 341/200
6,067,585 A * 5/2000 Hoang ..... 710/11
6,184,851 B1 * 2/2001 Yamaguchi et al. ..... 345/75.2
6,191,772 B1 * 2/2001 Mical et al. ..... 345/698
6,229,513 B1 * 5/2001 Nakano et al. ..... 345/99
6,243,061 B1 * 6/2001 Sandoe et al. ..... 345/91
6,445,367 B1 * 9/2002 Suzuki et al. ..... 345/75.2
6,483,493 B2 * 11/2002 Murade ..... 345/87

FOREIGN PATENT DOCUMENTS

| | | |
|---|---|---|
| JP | 62-173831 | 11/1987 |
| JP | 63-17477 | 2/1988 |
| JP | 63-276099 | 11/1988 |
| JP | 1-22625 | 4/1989 |
| JP | 01-207792 | 8/1989 |
| JP | 07-049664 | 2/1995 |

* cited by examiner

*Primary Examiner*—Richard Hjerpe
*Assistant Examiner*—Abbas I. Abdulselam
(74) *Attorney, Agent, or Firm*—David G. Conlin; William J. Daley, Jr.; Edwards Angell Palmer & Dodge

(57) ABSTRACT

A serial-to-parallel converter circuit is constructed of a plurality of D flip-flops receiving, as a clock signal, data in a single signal of serial data stored in a ROM. Each D flip-flop transmits "high" data to a next stage through a latch operation every time a piece of the data is read from the ROM. The plurality of D flip-flops converts the signal of serial data to parallel data by producing output signals as control signals. According to this arrangement, a signal production circuit and a display device incorporating it become available which allow for a reduction in the capacity, cost, and dimensions of the storage means, and also in the wiring and substrate areas required around the storage means, through more efficient use of the data stored in the storage means.

28 Claims, 10 Drawing Sheets

SIGNAL PRODUCTION CIRCUIT AND DISPLAY DEVICE USING THE SAME

FIELD OF THE INVENTION

The present invention relates to signal production circuits for producing a plurality of kinds of pulse signals which are respectively repetitions of a predetermined sequence of pulses, and also to display devices, such as capacitive flat matrix displays, liquid crystal displays, and plasma displays, incorporating such a signal production circuit.

BACKGROUND OF THE INVENTION

Matrix-type display devices, such as capacitive flat matrix displays, liquid crystal displays, and plasma displays, share similar peripheral mechanism for voltage application and its control, although they differ from each other in materials used for display elements and voltages supplied to display panels. A schematic arrangement of a capacitive flat matrix display is illustrated as an example in a block diagram constituting FIG. 7. As disclosed in Japanese Laid-Open Patent Application No. 60-95495/1985 (Tokukaisho 60-95495; published on 28 May, 1985), a display panel (EL panel) 71 of a capacitive flat matrix display shown in FIG. 7 includes: an electroluminescence element (hereinafter, will be referred to as an EL element) as an light emitting layer; transparent electrodes provided as data electrodes 71*a* on one of two surfaces of the EL element; and backside electrodes provided as scanning electrodes 71*b* on the other surface of the EL element. A pixel is formed at every crossing point of the data electrodes 71*a* and the scanning electrodes 71*b*, so the display panel 71 has pixels arranged in a matrix form.

A scanning driver 72 is connected to the scanning electrodes 71*b*, supplying predetermined voltage to the scanning electrodes 71*b* through operation of a shift register circuit 73. A data driver 74 is connected to the data electrodes 71*a*, supplying predetermined voltage to the data electrodes 71*a* through operation of a shift register and latch circuit 75. A drive circuit 76 includes a write drive circuit 76*a* and a modulation drive circuit 76*b* and produces a high voltage for the display panel 71 from voltage, VD, (for example, 12V) for use in a drive circuit supplied from a power source 80 according to a control signal input from a drive logic circuit 77. The write drive circuit 76*a* supplies write voltage (for example, 200V) to the scanning driver 72 which then supplies the voltage to pixels illuminate the display panel 71. The modulation drive circuit 76*b* supplies modulation voltage (for example, 40V) to the data driver 74 which then turns on or off the EL elements according to display data.

The drive logic circuit 77 produces timing signals (control signals) 78 and 79 to drive the display panel 71 from voltage, VL, (for example, 5V) for use in a logic circuit supplied from the power source 80 according to display data D and input signals including clock signals CK for display data transfer, horizontal synchronous signals H, and vertical synchronous signals V. The data (digital data) to produce the timing signals 78 and 79 is stored in an internal ROM (Read Only Memory) 77*a*. The timing signal 78 is used to control the timing of the write voltage supply from the write drive circuit 76*a*. Meanwhile, the timing signal 79 is used to control the timing of the modulation voltage supply from the modulation drive circuit 76*a*.

FIG. 8(*a*) and FIG. 8(*b*) show a control signal production circuit 81 for write drive provided inside the drive logic circuit 77, a timing chart of its control signals, and a waveform of a write drive voltage supplied to the display panel 71. As shown in FIG. 8(*a*), The ROM 77*a* provides four control signals W1 (write 1), W2 (write 2), D1 (discharge 1), and D2 (discharge 2) as parallel data for transistor control. Then, as shown in FIG. 8(*b*), the control signal W1 rises first among the four control signals to charge from 0V to 100V (first charge). The control signal W2 subsequently rises to charge form 100V to 200V (second charge). When being charged to 200V, the EL element luminesces. When the EL element is to be turned off, the control signal D1 rises to discharge from 200V to 100V (first discharge). The control signal D2 subsequently rises to discharge from 100V to 0V (second discharge).

In a conventional control signal production circuit 81, as detailed in the above, the ROM 77*a* stores all the data required to drive the display panel 71 for each kind of control signals and therefore needs a large storage capacity. For example, in the case illustrated in FIG. 8(*a*) and FIG. 8(*b*), the ROM 77*a* must store all the data representative of "high" and "low" level sections of each of the control signals W1, W2, D1, and D2. Besides, since the ROM 77*a* provides parallel data for each of the control signals, an increased number of output lines are required to transfer a large amount of data per unit time. For these reasons, the conventional control signal production circuit 81 has problems including overgrown dimensions and cost of the ROM 77*a* due to too large an amount of data, increases in the wiring area to enable parallel transfer of data and also in the substrate area.

SUMMARY OF THE INVENTION

The present invention has an object to present signal production circuits that allow for a reduction in the capacity, cost, and dimensions of a ROM and other storage means and also in the wiring and substrate areas required around the storage means, through more efficient use of the data stored in the storage means. The present invention has another object to present display device incorporating such a signal production circuit.

To achieve the first object, a signal production circuit in accordance with the present invention is a signal production circuit for producing, from digital data, a plurality of kinds of pulse signals which are respectively repetitions of a predetermined sequence of pulses, and is characterized in that it includes:

storage for storing, as the digital data, a single signal of serial data including a time series of data pulses representative of all rise and fall timings of the plurality of kinds of pulse signals and data pulses representative of all time intervals between the rise and fall timings; and serial-to-parallel converter for reading the signal of serial data from the storage and producing, as parallel data, the plurality of kinds of pulse signals from the data representative of all the predetermined rise and fall timings of the plurality of kinds of pulse signals.

According to the invention, the serial-to-parallel converter produces a plurality of kinds of pulse signals by converting a single signal of data stored in the storage from serial to parallel. The parallel conversion is carried out using predetermined data contained in the signal of serial data representative of the rise and fall timings of all the pulse signals, and the produced pulse signals are provided as parallel output data via individual paths. The pulse signals are divided into two or more kinds which have same or different rise and fall timings. The serial data includes a time series of data pulses representative of rise and fall timings of the pulse signals. Therefore, the data pulses constituting the serial data may be arranged in any time series, that is, any pulse width and timing relative to each other. Hence, a plurality of kinds of pulse signals can be readily produced with various rise and fall timings.

Further, since the gross amount of data does not change before and after a normal serial-to-parallel conversion, the amount of data does not change between a case where the serial data prepared by merging individual pieces of data, each piece representative of one of the pulse signals, is simply read and converted from serial to parallel and a case where all the data is stored in advance in the storage for each kind of the pulse signals and directly read as parallel data. In contrast, in the present embodiment, a single signal of serial data is prepared by using both the data pulses representative of all the rise and fall timings of the pulse signals and the data pulses representative of time intervals between the rise and fall timings. In this manner, those pieces of data that are redundant in terms of time series in the production of the pulse signals are eliminated. Accordingly, the storage needs to store only a fraction of the gross amount of data and transfer only a fraction of the gross amount of data per unit time. In addition, only a single signal of serial data needs to be read from the storage; therefore, the storage requires only a single pair of terminal and data output line.

Hence, the data stored in the ROM or other storage is thus used with increased efficiency. This enables reduction in the capacity, cost, and dimensions of the storage and also in the wiring and substrate areas required around the storage.

To achieve the second object, a display device in accordance with the present invention is characterized in that it is provided with a signal production circuit for producing, from digital data, a plurality of kinds of pulse signals which are respectively repetitions of a predetermined sequence of pulses, the signal production circuit including:

storage for storing, as the digital data, a single signal of serial data including a time series of data pulses representative of all rise and fall timings of the plurality of kinds of pulse signals and data pulses representative of all time intervals between the rise and fall timings; and serial-to-parallel converter for reading the signal of serial data from the storage and producing, as parallel data, the plurality of kinds of pulse signals from the data representative of all the predetermined rise and fall timings of the plurality of kinds of pulse signals.

According to the invention, the provision of a signal production circuit for producing the plurality of kinds of pulse signals allows for a reduction in the capacity, cost, and dimensions of the storage such as a ROM and also in the wiring and substrate areas required around the storage. Hence, the provision allows for a reduction in the cost and dimensions, especially, the area, of the display device.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a timing chart of signals during an operation of the signal production circuit of FIG. 1(*a*).

FIG. 4(*b*) is a timing chart of signals during an operation of the circuit of FIG. 4(*a*).

FIG. 5(*c*) is a timing chart of signals during an operation of the circuit of FIG. 5(*a*) and FIG. 5(*b*).

FIG. 6(*b*) is a timing chart of signals during an operation of the signal production circuit of FIG. 6(*a*).

FIG. 8(*b*) is a timing chart of signals and sequence controlled according to the signals during an operation of the conventional signal production circuit of FIG. 8(*a*).

DESCRIPTION OF THE EMBODIMENTS

Embodiment 1

Figure 1:
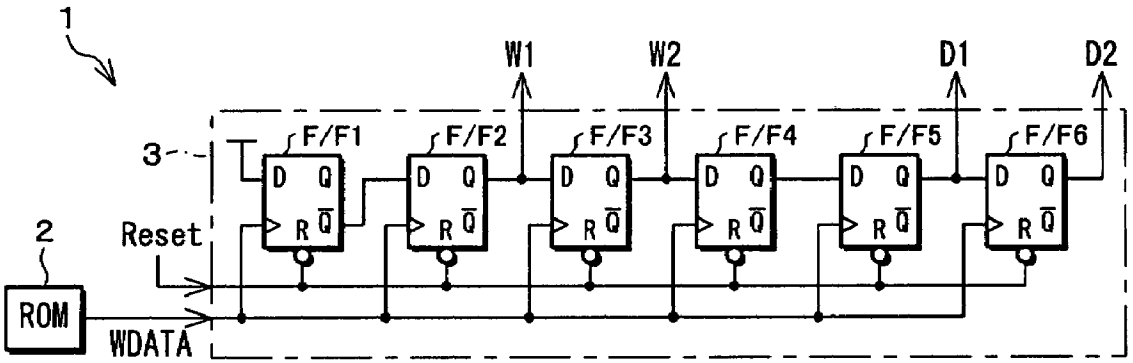
FIG. 1(*a*) is a circuit block diagram showing, as an example, an arrangement of a signal production circuit of an embodiment in accordance with the present invention.
Figure 1:
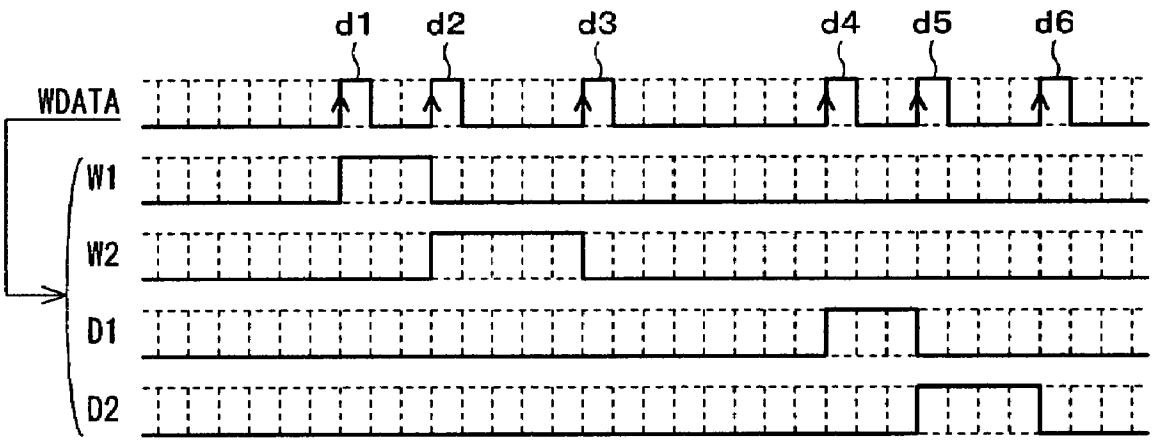

The following description will discuss an embodiment of a signal production circuit in accordance with the present invention in reference to FIGS. 1(*a*), 1(*b*), 2, 3, 4(*a*), 4(*b*), 5(*a*), 5(*b*), and 5(*c*). The description of the present embodiment will be made regarding a case where a signal production circuit is employed to produce control signals (pulse signals) to drive, in a predetermined sequence, a capacitive flat matrix display (hereinafter, will be abbreviated EL display device) as a display element including display pixels which are EL elements. However, the signal production circuit in accordance with the present invention is not limited to this particular case and is applicable to production of control signals to drive, in a predetermined sequence, a matrix-type display element such as a liquid crystal display or a plasma display. The signal production circuit in accordance with the present invention is not only applicable to addressing a display element, but further applicable to any production of a plurality of kinds of pulse signals which are respectively repetitions of a predetermined pulse sequence.

FIG. 1(*a*) illustrates an arrangement of a control signal production circuit (signal production circuit) 1 of the present embodiment. Constituted by a ROM 2 and a serial-to-parallel converter circuit 3, the control signal production circuit 1 is capable of producing four control signals W1, W2, D1, and D2 each of which rises and falls at different timings from the others for use in sequential drive of an EL display device similarly to the signals of FIG. 7.

The ROM (storage means) 2 is an integrated circuit storing serial data signal WDATA from which the control signals W1, W2, D1, and D2 are produced. As shown in FIG. 1(*b*), the serial data signal WDATA includes a time series of "high" data pulses (data) d1 to d6 and "low" data. The high data pulses d1 to d6 are representative of rise and fall timings at which the control signals W1, W2, D1, and D2 rise and fall. The low data is representative of time intervals between the rise and fall timings.

The serial data signal WDATA includes a time series of data pulses. The rise of each data pulse is representative of the rise and/or fall timings of the control signals W1, W2, D1, and D2. The serial data signal WDATA contains a data pulse (data) d1 whose rise timing is representative of the rise timing of the control signal W1, a data pulse d2 whose rise timing is representative of the fall timing of the control signal W1 and the rise timing of the control signal W2, a data pulse d3 whose rise timing is representative of the rise timing of the control signal W1, a data pulse d4 whose rise timing is representative of the rise timing of the control signal D1, a data pulse d5 whose rise timing is representative of the fall timing of the control signal D1 and the rise timing of the control signal D2, and a data pulse d6 whose rise timing is representative of the rise timing of the control signal D1.

The serial-to-parallel converter circuit (serial-to-parallel converter means) 3 is constituted by six cascade-connected D flip-flops F/F1 to F/F6. The serial data signal WDATA which is read from the ROM 2 via predetermined one of its terminals is supplied to the clock terminals of the D flip-flops F/F1 to F/F6 as a common clock signal. A common reset signal is supplied to the R terminals of all the D flip-flops. A high level signal is always supplied to the D terminal of the D flip-flop F/F1. The signal output from the $\overline{Q}$ terminal of the D flip-flop F/F1 is the signal input to the D terminal of the D flip-flop F/F2.

As to the D flip-flops F/F2 to F/F5, the signal output from the Q terminal of one is the signal input to the D terminal of the next. Being designated as parallel control signals W1, W2, D1, and D2, the signal outputs via the Q terminals of the second-, third-, fifth-, and sixth-stage D flip-flops F/F2, F/F3, F/F5, and F/F6 are transmitted through individual paths and supplied as inputs to a display device drive circuit.

Now, the operations of the control signal production circuit 1 arranged as above will be explained. The operations do not differ if "high" and "low" levels of the serial data signal WDATA, and the control signals W1, W2, D1, and D2 are reversed. A reset operation is performed by applying a reset signal to all the D flip-flops of FIG. 1(*a*). The completion of the reset operation triggers the reading of the serial data signal WDATA of FIG. 1(*b*) from the ROM 2. The D flip-flop F/F1 provides high data output from its $\overline{Q}$ terminal concurrently with the reset operation. As the D flip-flop F/F1 receives the high data pulse d1, which is the first pulse constituting the serial data signal WDATA, it latches data input from its D terminal in synchronism with the rise timing of the data pulse d1 and provides data output from its Q or $\overline{Q}$ terminal. Subsequently, the D flip-flop F/F2 latches high data input from its D terminal and provides data output from its Q terminal.

The flip-flop F/F2 remains in this state until it receives the high data pulse d2, which is a next pulse constituting the serial data signal WDATA. Accordingly, the latch period extending from one latch timing to next is equal to the time interval from an application of a high data pulse (or low data pulse) to a next application of a high data pulse (or low data pulse) in the serial data signal WDATA. In the above case, since the reading interval from the data pulse d1 to the data pulse d2 is set to be equal to the duration in which the control signal W1 is high, the control signal W1 of FIG. 1(*b*) appears at the output of the second-stage D flip-flop F/F2. In this manner, the control signal which appears at the output of a D flip-flop is determined by the relative position of the D flip-flop in the cascade.

As each D flip-flop receives the data pulse d2, it latches data in synchronism with the rise timing of the data pulse d2 in the same manner as in the foregoing. Besides, after having received the data pulse d1, the D flip-flop F/F1 always provides low level output from the $\overline{Q}$ terminal. Accordingly, when the D flip-flop F/F2 receives the data pulse d2, the D flip-flop F/F2 provides a low data output from its Q terminal, causing the control signal W1 to fall. Concurrently, the D flip-flop F/F3 provides a high data output from its Q terminal. In this case, since the reading interval from the data pulse d2 to the data pulse d3 is set to be equal to the duration in which the control signal W2 is high, the control signal W2 of FIG. 1(*b*) appears at the output of the third-stage D flip-flop F/F3.

Thus, data is transferred sequentially from the D flip-flop F/F2 to the D flip-flop F/F6 in synchronism with the rise timings of the data pulses d1 to d6 constituting the serial data signal WDATA. Accordingly, the control signal D1 rises in synchronism with the rise of the data pulse d4 and falls in synchronism with the rise of the data pulse d5, and the control signal D2 rises in synchronism with the rise of the data pulse d5 and falls in synchronism with the rise of the data pulse d6.

In the present embodiment, the serial data signal WDATA is thus converted to parallel data by deriving output signals from predetermined ones of the D flip-flops. Desired control signals become available by deriving output signals from appropriately selected D flip-flops. Therefore, parallel control signals W1, W2, D1, and D2 can be readily produced from serial data signal WDATA using a known latch circuit.

As described above, the serial-to-parallel converter circuit 3 produces the four control signals W1, W2, D1, and D2 by converting serial data signal WDATA, which is stored in the ROM 2 and supplied to the serial-to-parallel converter circuit as a single signal, from serial to parallel through latch operations of the D flip-flops F/F1 to F/F6 which operate on the data pulses d1 to d6, as a clock signal, constituting the serial data signal WDATA. The control signals W1, W2, D1, and D2 should be produced with a predetermined relationship of timings as shown in FIG. 1(*b*) so as to drive the EL display device in a predetermined sequence; however, the data pulses d1 to d6 constituting the serial data signal WDATA may be arranged in any time series, that is, any pulse width and position (timing) relative to each other. The data pulses d1 to d6 can therefore readily create relative timings which are suitable to a desired sequence.

Since the gross amount of data does not change before and after a normal serial-to-parallel conversion, the amount of read-out data does not change between a case where the serial data prepared by merging individual pieces of data, each piece representative of one of the control signals W1, W2, D1, and D2, is simply read out and converted from serial to parallel and a case where all the data is stored in advance in the ROM 2 for each one of control signals W1, W2, D1, and D2 and directly read out as parallel data. In contrast, in the present embodiment, a single serial data signal WDATA is prepared by using both the data pulses d1 to d6 representative of the rise and fall timings of the control signals W1, W2, D1, and D2 for use in predetermined sequential drive of an EL display device and the data representative of time intervals between the rise and fall timings.

In this manner, those pieces of data that are redundant in terms of time series in the production of the control signals W1, W2, D1, and D2 are eliminated. Specifically, no more data is required than the data representative of timings of switchings from low to high and vice versa. Further, the timings of switchings of the four signals are controllable with a single serial data signal alone. Accordingly, the ROM 2 needs to store ¼ times the gross amount of data, and transfer ¼ times the gross amount of data per unit time. In addition, only a single serial data signal WDATA needs to be read from the ROM 2; therefore, the ROM 2 requires only a single pair of terminal and data output line instead of four. The data stored in the ROM 2 is thus used with increased efficiency. This enables reduction in the capacity, cost, and dimensions of the ROM 2 and also in the wiring and substrate areas required around the ROM 2.

Figure 2:
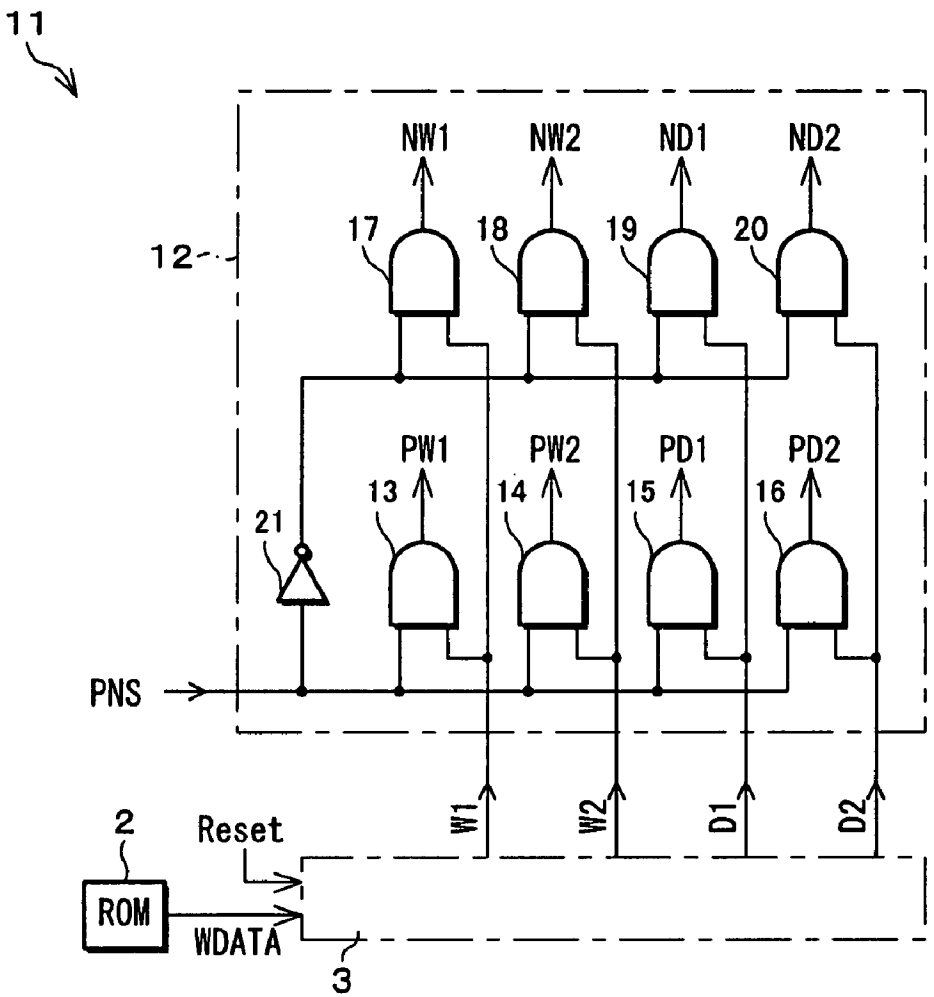
FIG. 2 is a circuit block diagram showing, as another example, an arrangement of a signal production circuit of an embodiment in accordance with the present invention.

FIG. 2 shows an alternative arrangement of the above signal production circuit of the present embodiment, whereby the produced control signals W1, W2, D1, and D2 are supplied to a plurality of circuits operating in the same pulse sequence. The control signal production circuit (signal production circuit) 11 of FIG. 2 is constituted by the control signal production circuit 1 of FIG. 1(*a*) and an additional control switching circuit (control switching means) 12.

For AC drive of an EL display device, the control switching circuit 12 converts the produced control signals W1, W2, D1, and D2 into the control signals PW1, PW2, PD1, and PD2 and the control signals NW1, NW2, ND1, and ND2 which are valid for every other frame periods and supplies them to a P drive circuit and an N drive circuit, so as to switch between the P and N drive circuits at the start of every frame period. The P and N drive circuits drive the EL display device with the application of positive and negative voltage (P drive and N drive) respectively to the scanning electrodes.

A part supplying signals to the P drive circuit is constituted by AND gates 13, 14, 15, and 16 which perform an AND operation between the control signals W1, W2, D1, and D2 and an externally supplied identification signal PNS to produce control signals PW1, PW2, PD1, and PD2 respectively. A part supplying signals to the N drive circuit is constituted by AND gates 17, 18, 19, and 20 and an inverter 21. The inverter 21 inverts the identification signal PNS, and the AND gates 17, 18, 19, and 20 perform an AND operation between the control signals W1, W2, D1, and D2 and the inverted signal to produce control signals NW1, NW2, ND1, and ND2 respectively.

The level of the identification signal PNS is inverted for each frame period of the control signals W1, W2, D1, and D2 so that the identification signal PNS represents a high level in P drive periods and a low level in N drive periods. The control signals PW1, PW2, PD1, and PD2 thus produced, equaling the control signals W1, W2, D1, and D2 respectively in P drive and being a low level unchangeably in N drive, are used to control a first writing (charging), a second writing (charging), a first discharge, and a second discharge in P drive of the EL element. Similarly, the control signals NW1, NW2, ND1, and ND2, being a low level unchangeably in P drive and equaling to the control signals W1, W2, D1, and D2 in N drive, are used to control a first writing (charging), a second writing (charging), a first discharge, and a second discharge in N drive of the EL element.

In other words, the control signals W1, W2, D1, and D2 are supplied to the P drive circuit as the control signals PW1, PW2, PD1, and PD2 in P drive (cycles in which the identification signal PNS is a high) and to the N drive circuit as the control signals NW1, NW2, ND1, and ND2 in N drive (cycles in which the identification signal PNS is a low).

Therefore, the arrangement of FIG. 2 is capable of producing eight signals from a single serial data signal WDATA in the ROM 2. Accordingly, compared to a case where all the data for each of the eight signals is stored in the ROM 2 to provide them as parallel data without any processing, the amount of data that should be stored is reduced to ⅛. Since the circuits which operate in sequences of a common frame period can share the serial data signal WDATA, the amount of data that should be stored in the ROM 2 is further reduced.

Figure 3:
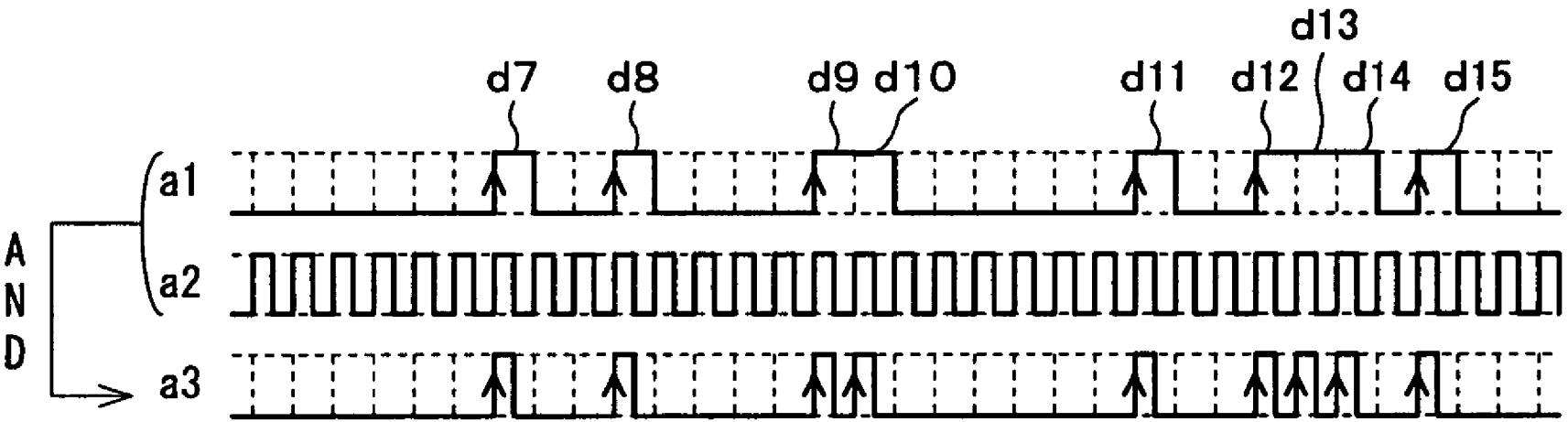
FIG. 3 is a timing chart of signals during an operation of a signal production circuit including another arrangement of an embodiment in accordance with the present invention.

Referring to FIG. 3, the following description will discuss an arrangement whereby the above-mentioned serial data signal WDATA read from the ROM 2 by the control signal production circuits 1 and 11 is converted to parallel data after it is subjected to conversion with respect to the pulse width of the data pulse (the duration in which the signal stays high). The signal a1 of FIG. 3 is the serial data signal WDATA from the ROM 2, comprising data pulses d7 to d15 representative of high levels. In some parts of the signal, the high level appears continuously over a plurality of data pulses: namely, the data pulses d9 and d10 and the data pulses d12 to d14. The serial-to-parallel converter circuit 3, if clocked with the signal a1 per se, cannot produce a rising or falling control signal where the signal fails to represent a data boundary with the high level appearing continuously.

To solve the problem, as shown in FIG. 3, the signal a1 is ANDed with an external signal a2 carrying supplementary data signal a2 which is a pulse signal having a pulse period (cycle) equal to the base pulse width (data interval) of the signal a1, and having a base pulse width (interval) half the base pulse width (data interval) of the signal a1, using an AND gate (not shown) in the serial-to-parallel converter circuit 3. If the signal a1 is adapted to rise at rise timings of the supplementary data signal a2, the resultant output is a signal a3, shown in FIG. 3, which rises at the same timings as the signal a1 and also at the boundaries of the data pulses d9 and d10 and of the data pulses d12 to d14. In these circumstances, the signal a3 has pulse widths half those of the signal a1.

In this manner, the control signal is produced with rise and fall timings that are suitably modified based on the resultant rise timings of the signal a3.

The arrangement is applicable in general to supplementary data signal a2 with a pulse period 1/n times the base pulse width of the signal a1, where n is an integer. Thus, the number of rise and fall timings can be increased to any given integer. Further, all the rise and fall timings of the control signal can be uniformly shifted slightly by moving the rise timings of the signal a1 off the rise timings of the signal a2 slightly and hence distorting the synchronism. A further alternative is the supplementary data signal a2 with a base pulse period which is equal to a value other than 1/n times a base pulse width of the signal a1, thereby producing a control signal with irregularly displaced rise and fall timings.

In this manner, the arrangement of FIG. 3 allows a variety of serial-to-parallel conversions by taking advantage of timings obtained from parts of the serial data signal where a high level appears continuously.

Figure 4:
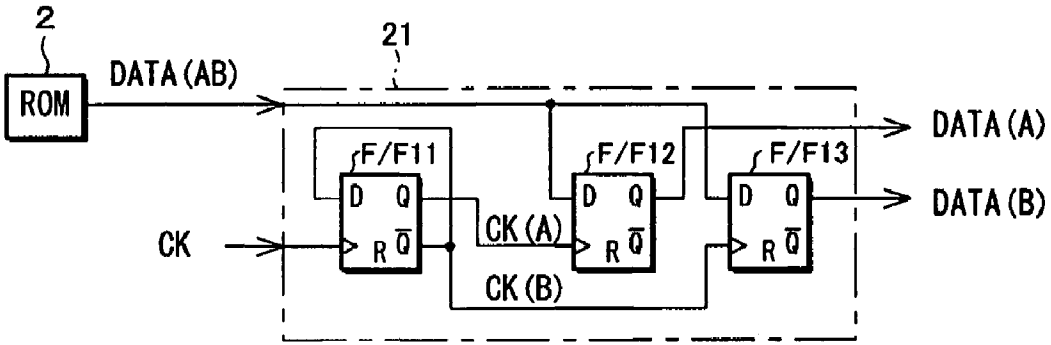
FIG. 4(*a*) is a circuit block diagram showing a part of a signal production circuit of a further arrangement of an embodiment in accordance with the present invention.
Figure 4:
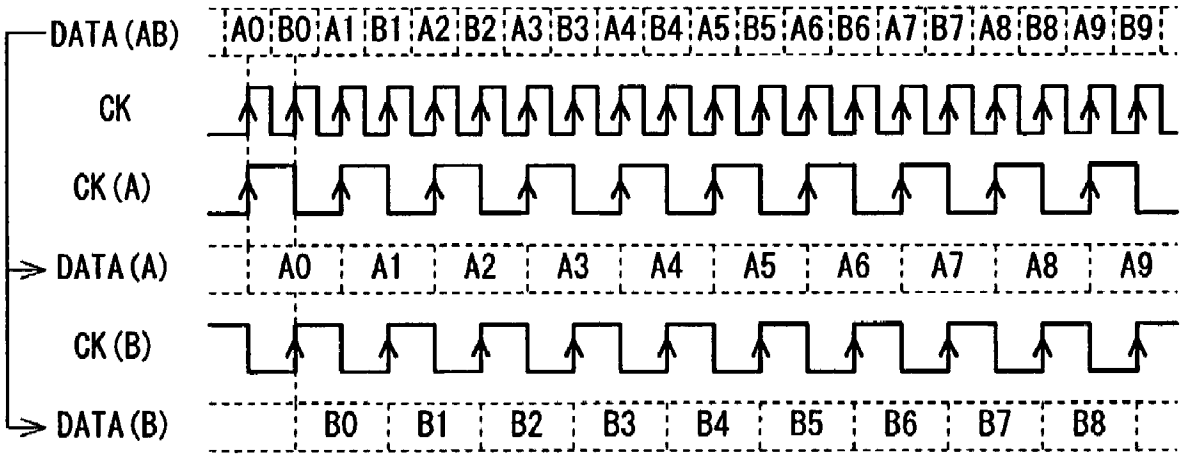

Now, referring to FIGS. 4(*a*), 4(*b*), and 5(*a*) to 5(*c*), the following description will discuss an arrangement whereby a plurality of sequences are controlled according to a single signal of serial data. FIG. 4(*a*) is a block diagram showing a sequence divider circuit 21 constituting a part of a serial-to-parallel converter circuit. The sequence divider circuit 21 divides a serial data signal DATA(AB) into a serial data signal DATA(A) representative of a sequence A and a serial data signal DATA(B) representative of a sequence B, so as to produce individual control signals for two sequences A and B from a single signal of serial data signal DATA(AB).

The sequence divider circuit 21 is constituted by D flip-flops F/F1, F/F12, and F/F13. The clock signal CK of FIG. 4(*b*) is supplied to the clock terminal of the D flip-flop F/F11. The D terminal of the D flip-flop F/F11 is connected to the $\overline{Q}$ terminal of its own and also to the clock terminal of the D flip-flop F/F13. The Q terminal of the D flip-flop F/F11 is connected to the clock terminal of the D flip-flop F/F12. The D terminals of the D flip-flop F/F12 and F/F13 are commonly connected to the output terminal of the ROM 2 from which the serial data signal DATA(AB) is supplied. Output signals are obtainable at the Q terminals of the D flip-flops F/F12 and F/F13.

The serial data signal DATA(AB), as shown in FIG. 4(*b*), is arranged in advance so as to contain data Ai (i=0 1 2, . . . ) representative of the sequence A and data Bj (j=0 1 2, . . . ) representative of the sequence B with a piece of data Ai and a piece of data Bj appearing alternately. The data Ai and the data Bj constitute individual sequences; there is, however, no relationship between the data Ai and the data Bj. These two sets of data are mutually independent. The clock signal CK is periodic, rising once in each reading period of the data Ai and Bj.

When the clock signal CK is supplied to the clock terminal of the D flip-flop F/F11 in FIG. 4(*a*), frequency-divided clock signals CK(A) and CK(B) appear at the Q and $\overline{Q}$ terminals respectively. As shown in FIG. 4(*b*), the clock signal CK(A) has rise timings only in reading periods of the data Ai, while the clock signal CK(B) has rise timings only in reading periods of the data Bj. Therefore, the D flip-flop F/F12 latches the serial data signal DATA(AB) according to the rise timings of the clock signal CK(A), and provides as an output the serial data signal DATA(A) comprising nothing more than the data Ai at its Q terminal. Meanwhile, the D flip-flop F/F13 latches the serial data signal DATA(AB) according to the rise timings of the clock signal CK(B), and provides as an output the serial data signal DATA(B) comprising nothing more than the data Bj at its Q terminal.

The serial data signal DATA(AB) is thus divided into the serial data signal DATA(A) in which the data Ai is arranged in a sequence corresponding to the sequence A and the serial data signal DATA(B) in which the data Bj is arranged in a sequence corresponding to the sequence B. Then, the serial data signal DATA(A) and DATA(B) are converted from serial to parallel in the same manner as in the foregoing, to enable production of individual control signals corresponding to the sequences A and B respectively. To effect the serial-to-parallel conversion, D flip-flops are prepared individually for the sequence A and the sequence B as shown in the serial-to-parallel converter circuit 3 of FIG. 1(*a*) and FIG. 1(*b*).

Figure 5:
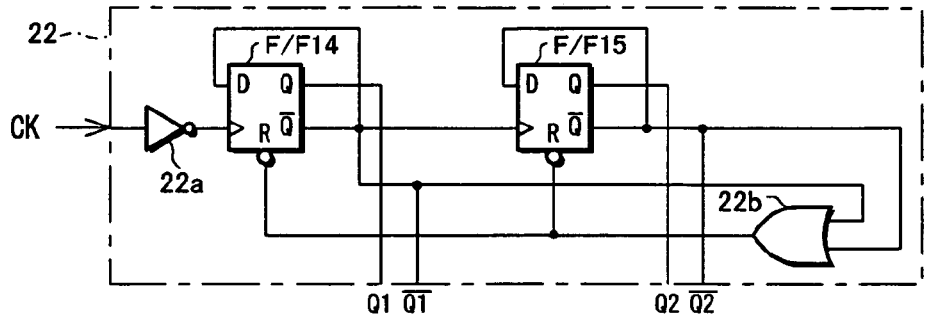
FIG. 5(*a*) and FIG. 5(*b*) are circuit block diagrams showing a part of a signal production circuit including another arrangement of an embodiment in accordance with the present invention.
Figure 5:
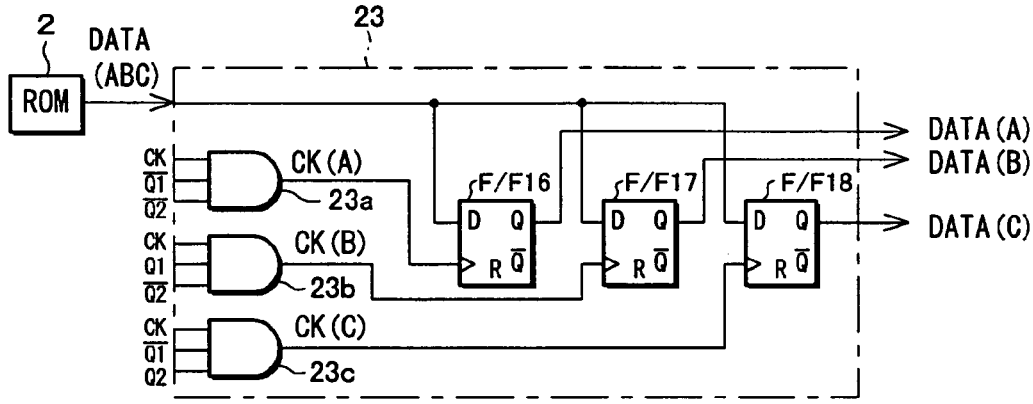
Figure 5:
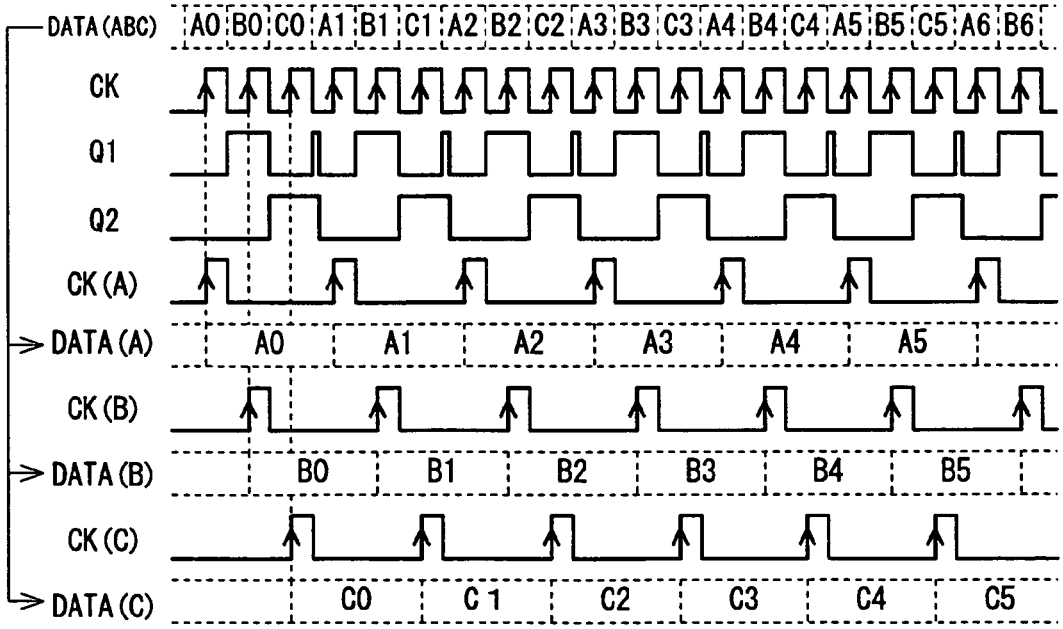

If N sequences should be controlled, a signal of original serial data signal DATA(ABC . . . ) is latched according to a combination of the clock signal CK and an output signal from an N-ary counter and thereby divided into N signals of serial data for N sequences. FIG. 5(*a*) is a circuit block diagram showing a ternary counter 22. FIG. 5(*b*) is a circuit block diagram showing a sequence divider circuit 23 when N=3.

The ternary counter 22 is constituted by a NOT gate 22*a*, an OR gate 22*b*, and D flip-flops F/F14 and F/F15. A clock signal CK of FIG. 5(*c*) is supplied to the NOT gate 22*a*, and the resultant output signal is supplied to the clock terminal of the D flip-flop F/F14. The OR gate 22*b* is coupled to the $\overline{Q}$ terminals of the D flip-flops F/F14 and F/F15, receiving input signals therefrom. The output signal from the OR gate 22*b* is supplied to the D flip-flops F/F14 and F/F15, serving a reset signal. The D terminals of the D flip-flops F/F14 and F/F15 are connected to their individual $\overline{Q}$ terminals, while the $\overline{Q}$ terminal of the D flip-flop F/F14 is connected to the clock terminal of the D flip-flop F/F15.

The output signals from the Q and $\overline{Q}$ terminals of the D flip-flop F/F14 are transmitted externally as signals Q1 and $\overline{Q1}$, while the output signals from the Q and $\overline{Q}$ terminals of the D flip-flop F/F15 are transmitted externally as signals Q2 and $\overline{Q2}$.

The sequence divider circuit 23 is constituted by AND gates 23*a*, 23*b*, and 23*c*, and D flip-flops F/F16, F/F17, and F/F18. A clock signal CK and signals Q1 and Q2 are supplied to the AND gate 23*a*, and the resultant output signal is supplied to the clock terminal of the D flip-flop F/F16. A clock signal CK and signals Q1 and $\overline{Q2}$ are supplied to the AND gate 23*b*, and the resultant output signal is supplied to the clock terminal of the D flip-flop F/F17. A clock signal CK and signals $\overline{Q1}$ and Q2 are supplied to the AND gate 23*c*, and the resultant output signal is supplied to the clock terminal of the D flip-flop F/F18. The D terminals of the D flip-flops F/F16, F/F17, and F/F18 are connected to the output terminal of the ROM 2, receiving a serial data signal DATA(ABC) therefrom. The output signals from the D flip-flops F/F16, F/F17, and F/F18 appear at the respective Q terminals.

The serial data signal DATA(ABC), as shown in FIG. 5(*c*), is arranged in advance so as to contain data Ai (i=0 1 2, . . . ) representative of a sequence A, data Bj (j=0 1 2, . . . ) representative a sequence B, and a Ck (k=0 1 2, . . . ) representative of a sequence C with a piece of data Ai, a piece of data Bj, and a piece of data Ck appearing in this order. The data Ai, the data Bj, and the data Ck constitute individual sequences; there is, however, no relationship between the data Ai, Bj, and Ck. These three sets of data are mutually independent. The clock signal CK is periodic, rising once in each reading period of the data Ai, Bj, and Ck.

When the clock signal CK is supplied to the ternary counter 22, the resultant signals Q1 and Q2 are representative of series of pulses shown in FIG. 5(*c*). The AND gate 23*a*, 23*b* and 23*c* in the sequence divider circuit 23 therefore provides as outputs clock signals CK(A), CK(B), and CK(C) which have rise timings only in reading periods of the data Ai, Bj, and Ck respectively.

The D flip-flop F/F16 latches the serial data signal DATA (ABC) according to the rise timings of the clock signal CK(A), and provides as an output the serial data signal DATA(A) comprising nothing more than the data Ai at its Q terminal. Meanwhile, the D flip-flop F/F17 latches the serial data signal DATA(ABC) according to the rise timings of the clock signal CK(B), and provides as an output the serial data signal DATA(B) comprising nothing more than the data Bj at its Q terminal. The D flip-flop F/F18 latches the serial data signal DATA(ABC) according to the rise timings of the clock signal CK(C), and provides an output the serial data signal DATA(C) comprising nothing more than the data Ck at its Q terminal.

The serial data signal DATA(ABC) is thus divided into the serial data signal DATA(A) in which the data Ai is arranged in a sequence corresponding to the sequence A, the serial data signal DATA(B) in which the data Bj is arranged in a sequence corresponding to the sequence B, and the serial data signal DATA(C) in which the data Ck is arranged in a sequence corresponding to the sequence C. Then, the serial data signals DATA(A), DATA(B), and DATA(C) are converted from serial to parallel in the same manner as in the foregoing, to enable production of individual control signals corresponding to the sequences A, B, and C respectively.

According to the arrangement of FIGS. 4(*a*), 4(*b*), and 5(*a*) to 5(*c*), control signals for more than one sequences can be produced from a single signal of serial data read from the ROM 2 via its single output line as detailed above.

Figure 9:
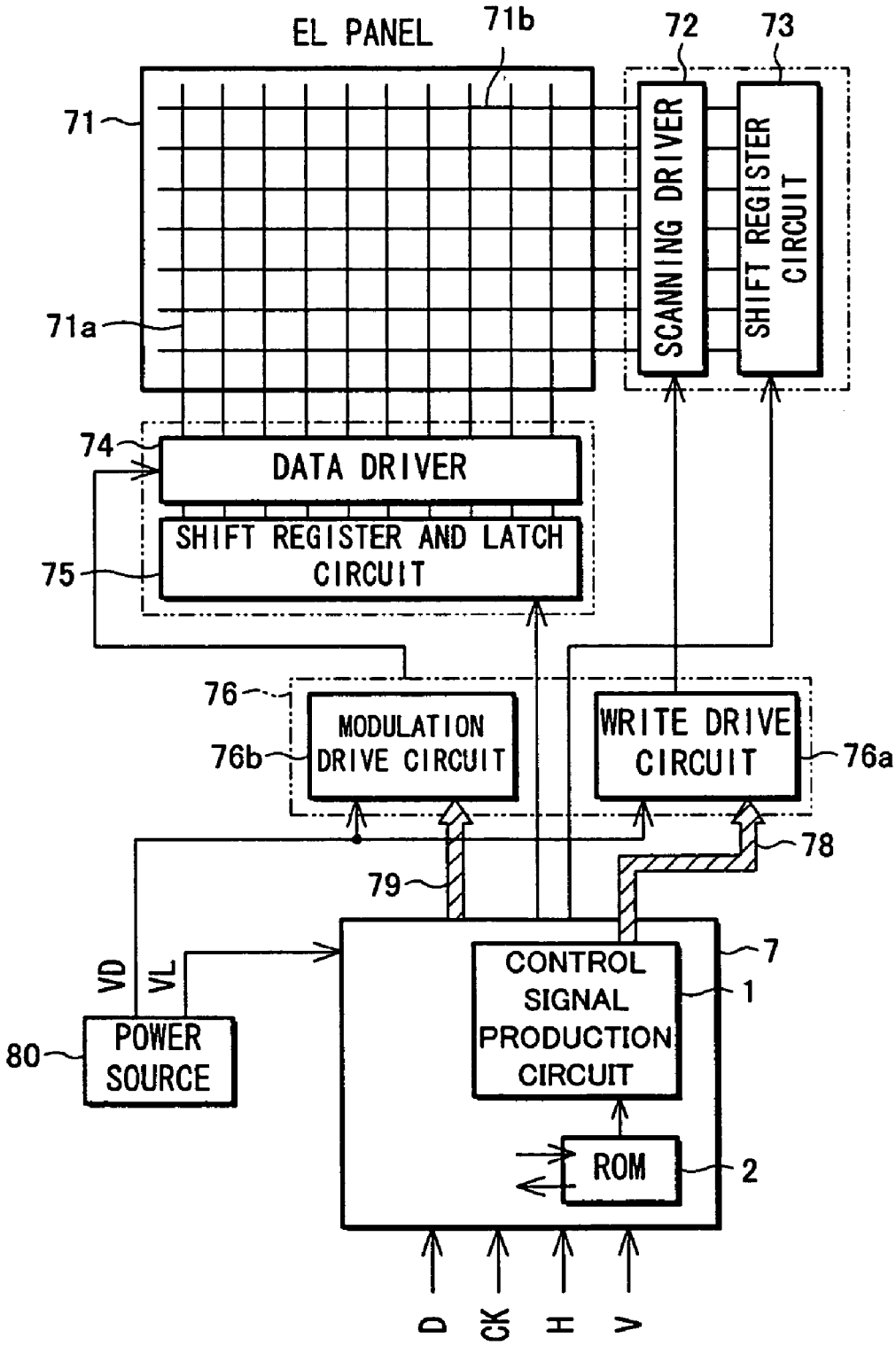
FIG. 9 is a block diagram showing, as an example, an arrangement of a display device of an embodiment in accordance with the present invention.

Referring to FIG. 9, the following description will discuss a display device incorporating a control signal production circuit 1 of the present embodiment as an embodiment of a display device in accordance with the present invention. Here, for convenience, members of the present embodiment that have the same arrangement and function as members of the display device of FIG. 7 which is detailed in reference to prior art technology are indicated by the same reference numerals and description thereof is omitted.

As shown in FIG. 9, a display device of the present embodiment includes, as an EL display device (display element), a display panel 71 having, as display pixels, EL elements (electroluminescence elements) described earlier in detail and further includes a scanning driver 72 described earlier in detail, a shift register circuit 73, a data driver 74, a shift register and latch circuit 75, a drive circuit 76, and a power source 80. The display device of the present embodiment differs from the display device of FIG. 7 in that the former includes a drive logic circuit 7 in place of the drive logic circuit 77.

The drive logic circuit 7 includes a control signal production circuit 1 as well as a ROM 2. As described earlier in detail, the control signal production circuit 1 produces control signals 78 (control signals W1, W2, D1, and D2) necessary to drive the display panel 71 from the serial data signal WDATA read from the ROM 2 in which the serial data signal WDATA is stored in advance.

According to the arrangement, the provision of the control signal production circuit 1 allows for a reduction in the capacity, cost, and dimensions of the ROM 2 and also in the wiring and substrate areas required for the drive logic circuit 7, through more efficient use of the data stored in the ROM 2 in advance.

The control signal production circuit 1 may be replaced with the control signal production circuit 11. The control signal production circuit 1 or 11 may additionally include a serial-to-parallel data converter circuit explained earlier in reference to FIG. 3 or a circuit capable of producing control signals for a plurality of sequences explained earlier in reference to FIGS. 4(*a*), 4(*b*), 5(*a*), 5(*b*), and 5(*c*).

Embodiment 2

Figure 6:
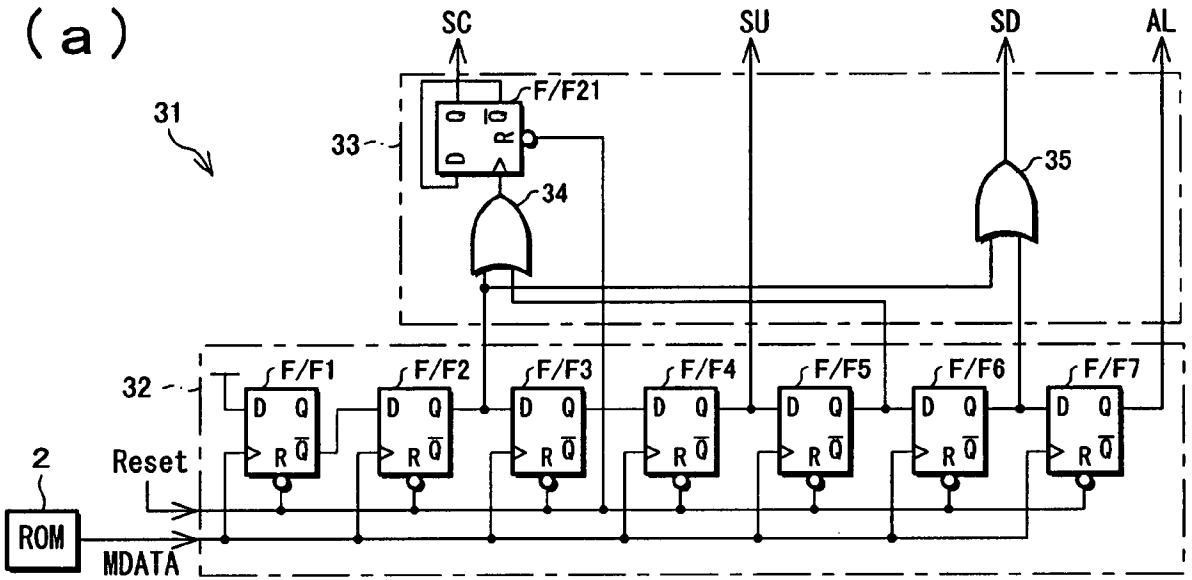
FIG. 6(*a*) is a circuit block diagram showing, an example, an arrangement of a signal production circuit of another embodiment in accordance with the present invention.
Figure 6:
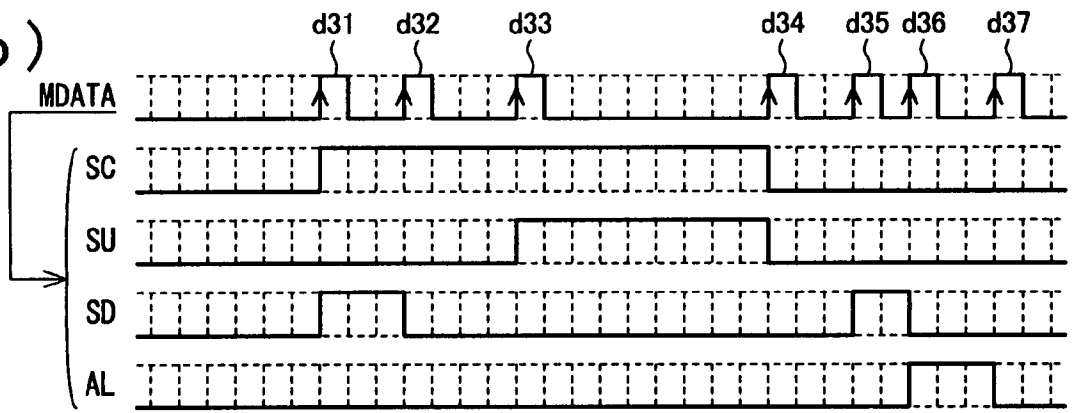

Referring to FIG. 6(*a*) and FIG. 6(*b*), the following description will discuss another embodiment of a signal production circuit in accordance with the present invention Here, for convenience, members of the present embodiment that have the same arrangement and function as members of embodiment 1, and that are mentioned in that embodiment are indicated by the same reference numerals and description thereof is omitted.

FIG. 6(*a*) shows an arrangement of a control signal production circuit (signal production circuit) 31 of the present embodiment. The control signal production circuit 31 has common features with embodiment 1 in that both produce a plurality of control signals with rise and fall timings occurring concurrently and separately to drive a display element in a predetermined sequence; however, the control signal production circuit 31 differs from embodiment 1: namely, the control signal production circuit 31 produces a control signal for use in modulation of the drive of an EL display device and four control signals SC, SU, SD, and AL that do not form cascades and is constituted by a ROM 2, a serial-to-parallel converter circuit 32, and a non-cascade signal production circuit 33. "Cascades-forming signals" refers to signals derived from flip-flops connected in cascade, that is, signals such that rise timings are mutually different and high level intervals do not mutually overlap. The four control signals SC, SU, SD, and AL produced in the present embodiment are not cascades-forming signals, because rise timings are different, but high level intervals overlap.

The serial-to-parallel converter circuit (serial-to-parallel converter means) 32 is constituted by seventh-stage D flip-flops F/F1 to F/F7 that are connected in cascade. Accordingly, the arrangement includes the serial-to-parallel converter circuit 3 of embodiment 1, plus a D flip-flop F/F7 added thereto in a similar manner. The output signals of the D flip-flops F/F2, F/F5, and F/F6 which appear at their Q terminals are input signals of the non-cascade signal production circuit 33. The output signals of the D flip-flops F/F4 and F/F7 which appear at their Q terminals are provided as control signals SU and AL respectively.

The non-cascade signal production circuit (combining means) 33 is constituted by OR gates 34 and 35 and a D flip-flop F/F21. The OR gate 34 performs an AND operation between the output signals of the second-stage D flip-flop F/F2 and the fifth-stage D flip-flop F/F5. The result of the operation in the OR gate 34 is supplied as the clock signal to the clock terminal of the D flip-flop F/F21. To the R terminal of the D flip-flop F/F21 is supplied the same reset signal as the one supplied to the serial-to-parallel converter circuit 32. The output signal from the $\overline{Q}$ terminal of the D flip-flop F/F21 is supplied to its own D terminal. The D flip-flop F/F21 provides, as an output, a control signal SC from its Q terminal. The OR gate 35 performs an AND operation between the output signals of the second- and sixth-stage D flip-flops F/F2 and F/F6 and provides the result of the operation as an output control signal SD.

Now, the following description will discuss operations of the control signal production circuit 31 arranged as above. It is supposed here that in the ROM 2 is stored a serial data signal MDATA shown in FIG. 6(*b*). The serial data signal MDATA is representative of high data pulses d31 to d37 and low data representative of the intervals between the data pulses. The operations do not differ if "high" and "low" levels of the serial data signal MDATA, and the control signals SC, SU, SD, and AL are reversed.

A reset operation is performed by applying a reset signal to all the D flip-flops of FIG. 6(*a*). The completion of the reset operation triggers the reading of the serial data signal MDATA of FIG. 6(*b*) from the ROM 2. As each of the D flip-flops F/F1 to F/F7 receives the high data pulse d31, which is the first pulse constituting the serial data signal MDATA, it latches data through D terminal in synchronism with the rise timing of the high data pulse d31 and provides data output from its Q or $\overline{Q}$ terminal.

In these circumstances, the output signal of the D flip-flop F/F2 is high, while the output signal of the D flip-flop F/F5 is low. Therefore, the output signal of the OR gate 34 is high, and the D flip-flop F/F21 latches data input from its D terminal. Since the output signal from the $\overline{Q}$ terminal is high up to the moment immediately before the latching, the output signal from the Q terminal becomes high upon the latching, causing the control signal SC to rise. Simultaneously, the output signal from the D flip-flop F/F6 becomes low, and the output signal from the OR gate 35 becomes high, causing the control signal SD to rise.

Subsequently, when data pulses d32 and d33 are read, the high output signal of the D flip-flop F/F2 is transferred to following stages sequentially. Since the output signals of the D flip-flops F/F2 and F/F5 both remain low until the data pulse d34 is read, the output signal of the OR gate 34 is low, and the D flip-flop F/F21 performs no latch operation. The control signal SC thus remains high. Further, when the data pulse d32 is read, the output signals of the D flip-flops F/F2 and F/F6 both remain low; therefore, the output signal of the OR gate 35 becomes low, causing the control signal SD to fall.

As the data pulse d33 is read, the output signal of the D flip-flop F/F4 becomes high, causing the control signal SU to rise. As the data pulse d34 is read, the output signal of the D flip-flop F/F5 becomes high; therefore, the output signal of the OR gate 34 becomes high, causing the D flip-flop F/F21 to latch low data and the control signal SC to rise. Under these conditions, the output signal of the D flip-flop F/F4 becomes low, causing the control signal SU to fall also.

As the data pulse d35 is read, the output signal of the D flip-flop F/F6 becomes high; therefore, the output signal from the OR gate 35 becomes high, causing the control signal SD to rise again. As the data pulse d36 is read, the output signals of the D flip-flops F/F2 and F/F6 both become low; therefore the output signal of the OR gate 35 low, causing the control signal SD to fall. In these circumstances, since the output signal of the D flip-flop F/F7 becomes high, the control signal AL rises. As the data pulse d37 is read, the output signal of the D flip-flop F/F7 falls.

As detailed in the above, in the present embodiment, the control signals SC and SD are produced by combining output signals of a plurality of D flip-flops. If a single control signal is to be produced from an output signal of a single D flip-flop, only cascade signals can be produced according to the sequence of the D flip-flops as long as no external signal is supplied. In contrast, as detailed in the above, since logic operations are executed by combining output signals of a plurality of D flip-flops, the control signals SC and SD can be produced so as to have the same rise and fall timings as discrete data pulses contained in the serial data signal MDATA.

This prevents the control signals SC, SU, SD, and AL from forming cascades. Further, the logic operations are modifiable so as to arbitrarily set the rise and fall timings, as well as their numbers, of control signals. As detailed in the above, according to the present embodiment, control signals can be produced which are suitable to a wide variety of sequences.

Needless to say, the present embodiment may incorporate the arrangement of FIGS. 3, 4(*a*), 4(*b*), 5(*a*), 5(*b*), and 5(*c*) which are referred to in embodiment 1.

Figure 10:
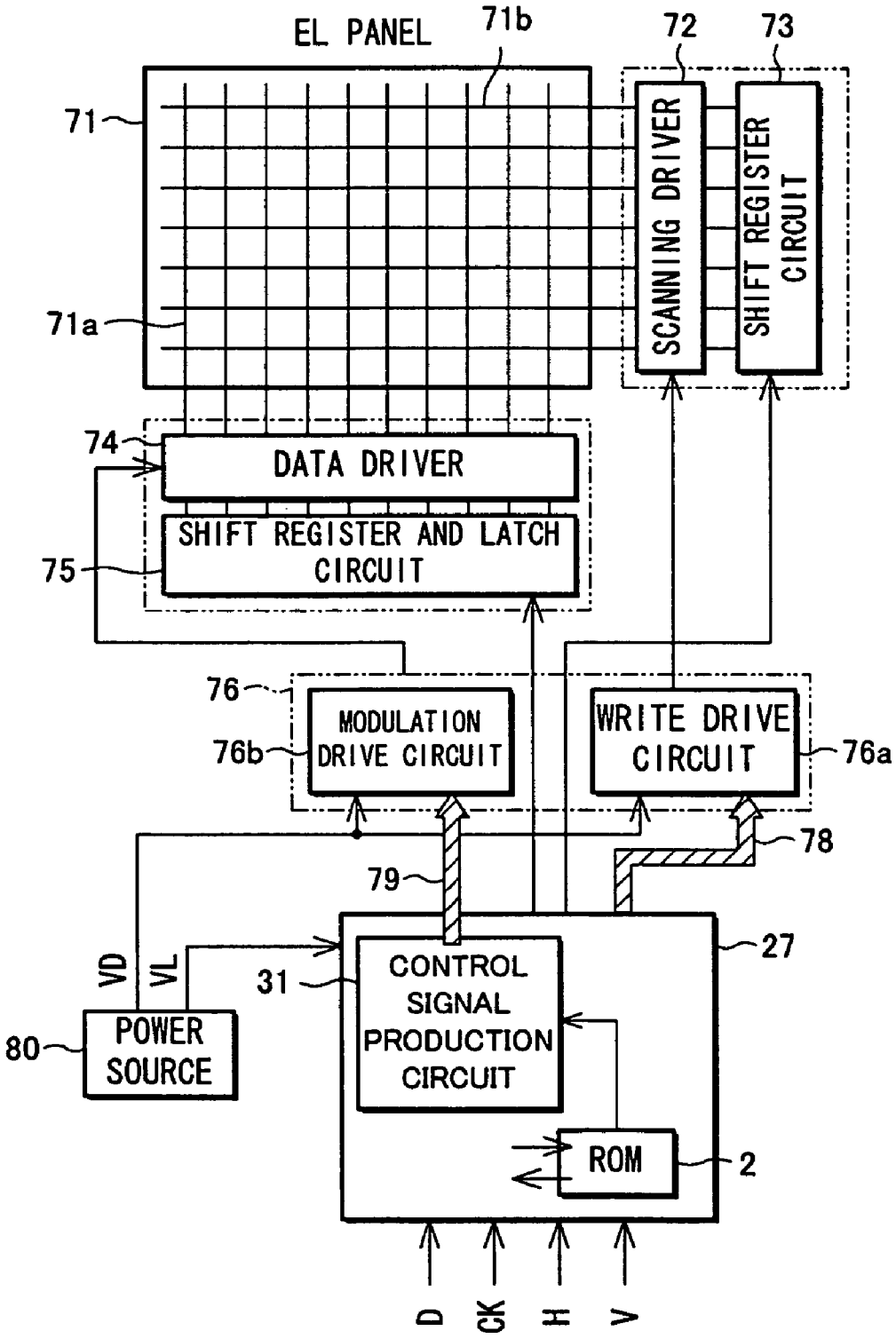
FIG. 10 is a block diagram showing, as an example, an arrangement of a display device of another embodiment in accordance with the present invention.

Referring to FIG. 10, the following description will discuss a display device incorporating a control signal production circuit of the present embodiment as an embodiment of a display device in accordance with the present invention. Here, for convenience, members that have the same arrangement and function as members of the display device of FIG. 7 which is detailed in reference to prior art technology or those of the display device of FIG. 9 which is detailed in embodiment 1 are indicated by the same reference numerals and description thereof is omitted.

As shown in FIG. 10, a display device of the present embodiment includes, as an EL display device (display element), a display panel 71 having, as display pixels, EL elements (electroluminescence elements) described earlier in detail and further includes a scanning driver 72 described earlier in detail, a shift register circuit 73, a data driver 74, a shift register and latch circuit 75, and a power source 80.

Figure 7:
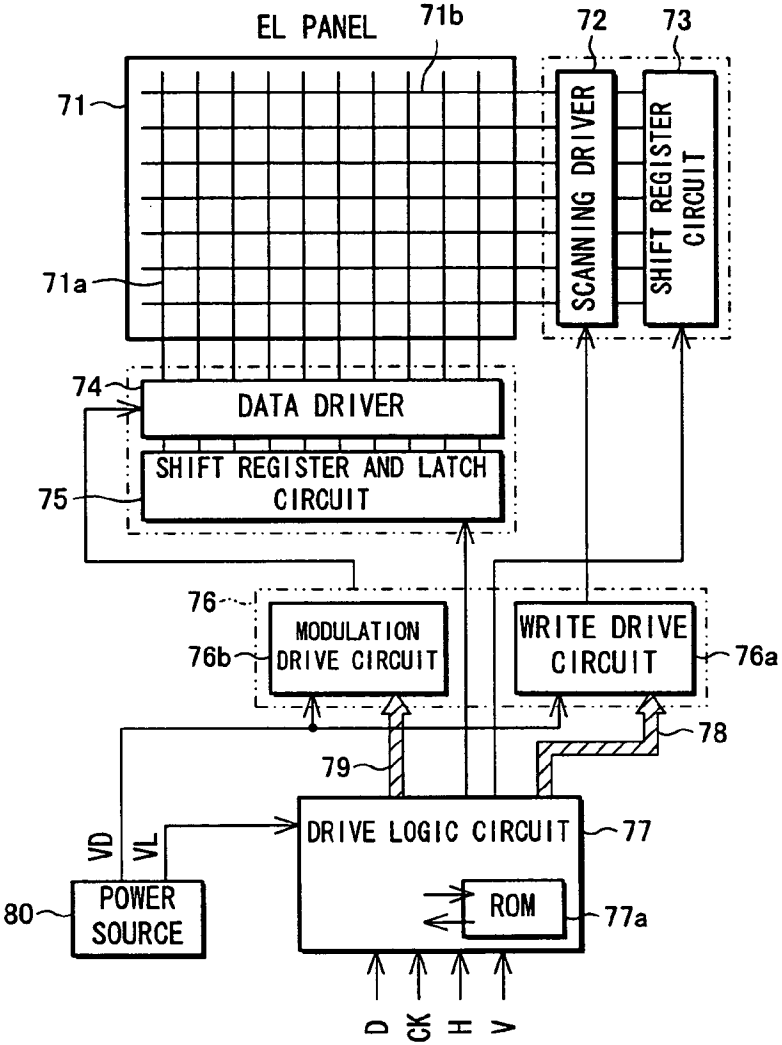
FIG. 7 is a block diagram showing an arrangement of a capacitive flat matrix display incorporating a conventional signal production circuit.
Figure 8:
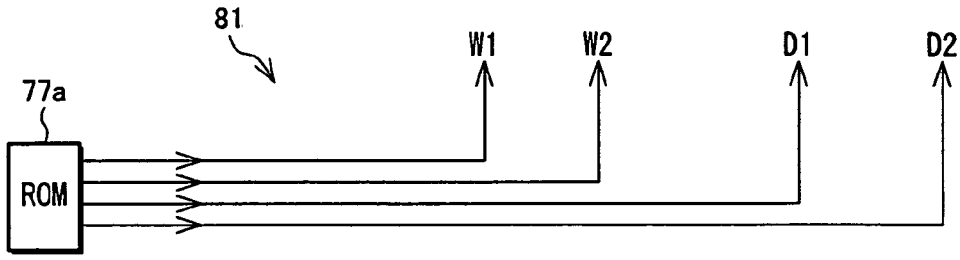
FIG. 8(*a*) is a circuit block diagram showing an arrangement of a conventional signal production circuit.
Figure 8:
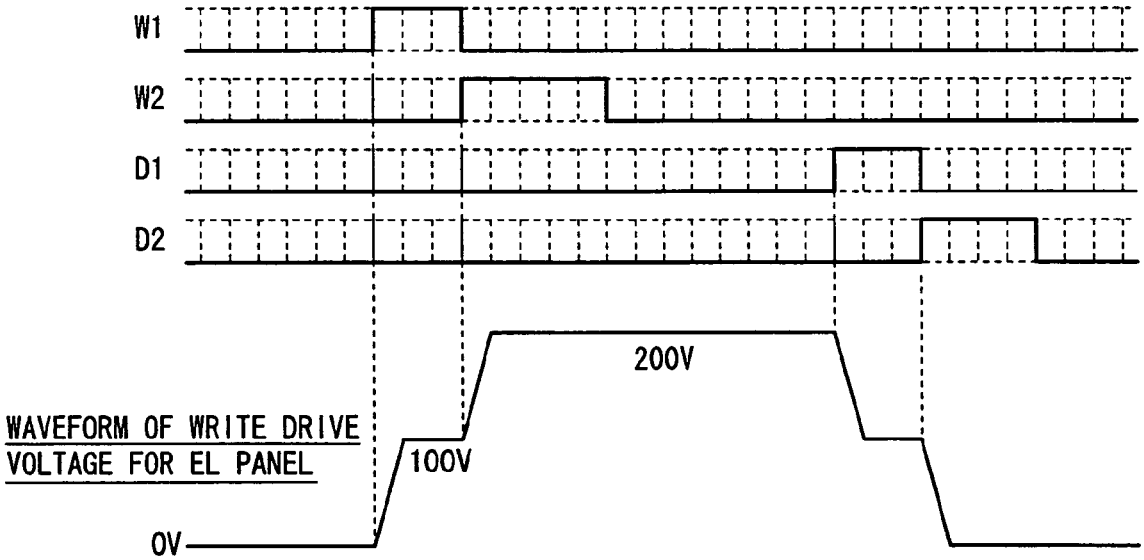

The display device of the present embodiment differs from the display device of FIG. 7 in that the former includes a drive logic circuit 27 in place of the drive logic circuit 77.

The drive logic circuit 27 includes a control signal production circuit 31 as well as an ROM 2. As described earlier in detail, the control signal production circuit 31 produces control signals 79 (control signals SC, SU, SD, and AL) necessary to drive the display panel 71 from the serial data signal MDATA read from the ROM 2 in which the serial data signal MDATA is stored in advance.

According to the arrangement, the provision of the control signal production circuit 31 allows for a reduction in the capacity, cost, and dimensions of the ROM 2 and also in the wiring and substrate areas required for the drive logic circuit 27, through more efficient use of the data stored in the ROM 2 in advance.

The control signal production circuit 31 may additionally include a serial-to-parallel data converter circuit explained earlier in reference to FIG. 3 or a circuit capable of producing control signals for a plurality of sequences explained earlier in reference to FIGS. 4(*a*), 4(*b*), 5(*a*), 5(*b*), and 5(*c*).

As detailed in the foregoing, a signal production circuit in accordance with the present invention is a signal production circuit for producing, from digital data, a plurality of kinds of pulse signals which are respectively repetitions of a predetermined sequence of pulses, and is arranged so that it includes:

storage means for storing, as the digital data, a single signal of serial data including a time series of data pulses representative of all rise and fall timings of the plurality of kinds of pulse signals and data pulses representative of all time intervals between the rise and fall timings; and serial-to-parallel converter means for reading the signal of serial data from the storage means and producing, as parallel data, the plurality of kinds of pulse signals from the data representative of all the predetermined rise and fall timings of the plurality of kinds of pulse signals.

Therefore, the signal of serial data includes a time series of data pulses representative of rise and fall timings of the plurality of pulse signals in a sequence corresponding to sequential drive. Therefore, the data pulses constituting the serial data may be arranged in any time series, which enables a timing relationship required between the plurality of pulse signals to be readily satisfied.

Further, a signal of serial data is composed containing both the data pulses representative of all the rise and fall timings of the pulse signals and the data representative of time intervals between all the rise and fall timings. Therefore, those pieces of data that are redundant in terms of time series in the production of the pulse signals are eliminated. Accordingly, the storage means needs to store, and transfer per unit time, a greatly reduced amount of data. In addition, only a single signal of serial data needs to be read from the storage means; therefore, the storage means requires only a single pair of terminal and data output line.

Hence, the data stored in the ROM or other storage means is thus used with increased efficiency. This enables reduction in the capacity, cost, and dimensions of the storage means and also in the wiring and substrate areas required around the storage means.

As detailed in the foregoing, a signal production circuit in accordance with the present invention is arranged so that the plurality of kinds of pulse signals are a plurality of control signals to drive a matrix-type display element in a predetermined sequence.

According to the invention, the serial-to-parallel converter means produces a plurality of control signals by converting a single signal of data stored in the storage means from serial to parallel. The parallel conversion is carried out using predetermined data contained in the signal of serial data representative of the rise and fall timings of all the control signals, and the produced control signals are provided as parallel output data via individual paths to a circuit in a next stage. The plurality of control signals should be produced with a predetermined relationship of timings so as to drive the display element in a predetermined sequence; however, the serial data includes a time series of data pulses representative of the rise and fall timings of the plurality of control signals in a sequence corresponding to sequential drive. Therefore, the data pulses constituting the serial data may be arranged in any time series, that is, any pulse width and pulse position (timing) relative to each other. Hence, the timing relationship can be readily satisfied for a variety of sequences.

Since the gross amount of data does not change before and after a normal serial-to-parallel conversion, the amount of data does not change between a case where the serial data prepared by merging individual pieces of data, each piece representative of one of control signals, is simply read and converted from serial to parallel and a case where all the data is stored in advance in the storage means for each kind of control signals and directly read as parallel data. In contrast, in the present embodiment, a single signal of serial data is composed containing both the data pulses representative of the rise and fall timings of the control signals for use in predetermined sequential drive of a display element and the data representative of time intervals between the rise and fall timings. In this manner, those pieces of data that are redundant in terms of time series in the production of the control signals are eliminated. Accordingly, the storage means needs to store only a fraction of the gross amount of data and transfer only a fraction of the gross amount of data per unit time. In addition, only a single signal of serial data needs to be read from the storage means; therefore, the storage means requires only a single pair of terminal and data output line.

Hence, the data stored in the ROM or other storage means is thus used with increased efficiency. This enables reduction in the capacity, cost, and dimensions of the storage means and also in the wiring and substrate areas required around the storage means.

As detailed in the foregoing, another signal production circuit in accordance with the present invention is arranged so that the serial-to-parallel converter means includes a plurality of flip-flops, connected in cascade so that an output signal of one flip-flop is an input signal of a next, which convert data from serial to parallel by sequentially latching input data based on the signal of serial data which serves as a common clock signal to all the flip-flops, and deriving output signals from predetermined ones of the plurality of flip-flops as the parallel data.

According to the invention, in the serial-to-parallel converter means, A plurality of flip-flops are connected in cascade so that an output signal of one flip-flop is an input signal of a next. Each flip-flop performs a latch operation based on the signal of serial data read from the storage means serving as a common clock signal every time a piece of data representative of a rise or fall timing of a desired pulse signal (control signal) is supplied to the clock terminal of each flip-flop.

The latch period extending from one latch timing to next is equal to the time interval from a reading of high data (or low data) to a next reading of high data (or low data) in the serial data. Accordingly, if the data reading interval is set to be equal to the duration in which the pulse signal (control signal) is high for example, a pulse signal (control signal) appears at the output of a flip-flop which latches high data supplied from a flip-flop in the previous stage upon the start of the latch period. Which pulse signal (control signal) appears at the output depends on the relative position of the flip-flop in the cascade. In the present invention, data is converted from serial to parallel by deriving output signals from predetermined ones of the plurality of flip-flops; desired pulse signals (control signals) become available by deriving output signals from appropriately selected flip-flops.

Hence a plurality of parallel pulse signals (control signals) can be readily produced from serial data, using a known latch circuit.

As detailed in the foregoing, another signal production circuit in accordance with the present invention is arranged so that it further includes combining means for producing the plurality of kinds of pulse signals (control signals) by combining output signals from the predetermined ones of the plurality of flip-flops.

According to the invention, output signals of a plurality of flip-flops are combined by the combining means to produce pulse signals (control signals). If a single pulse signal (control signal) is to be produced from an output signal of a single flip-flop, only cascade signals can be produced according to the sequence of the flip-flops as long as no external signal is supplied. In contrast, if logic operations are executed by combining output signals of a plurality of flip-flops, for example, the second- and fifth-stage flip-flops, pulse signals (control signals) can be produced such that the rise and fall timings are represented by discrete data contained in the serial data.

This prevents cascading of the pulse signal (control signal) with another pulse signal (control signal). Further, the logic operations are modifiable so as to arbitrarily set the rise and fall timings, as well as their numbers, of pulse signals (control signals). As detailed so far, according to the present invention, pulse signals (control signals) can be produced which are suitable to a wide variety of sequences.

As detailed in the foregoing, another signal production circuit in accordance with the present invention is arranged so that it further includes control switching means for supplying the produced plurality of kinds of pulse signals (control signals) to a plurality of circuits which operate in respective sequences of a common frame period, by switching from one circuit to another at the common frame period.

According to the invention, if there exist a plurality of circuits which operate in respective sequences of a common frame period, the control switching means switches from one circuit to another to sequentially supply the produced pulse signals (control signals). For example, if the pulse signals (control signals) are to be used to AC-drive a display element, the control switching means converts the produced pulse signals (control signals) into those which are valid for every other frame periods and supplies them to the drive circuits, so as to switch between drive circuits for addressing scanning electrodes so that every other display line is driven by positive voltage and the remaining lines are driven by negative voltage. In this manner, the circuits which operate in sequences of a common frame period can share the serial data; therefore, the amount of data that should be stored in the storage means is further reduced.

As detailed in the foregoing, a signal production circuit in accordance with the present invention is arranged so that the serial-to-parallel converter means performs an AND operation between the signal of serial data and supplementary data with a pulse period equal to, or shorter than, a base pulse width of the signal of serial data and with a base pulse width 1/n times that of the signal of serial data, where n is an integer, before the conversion to the parallel data is performed.

According to the invention, external supplementary data is supplied with a pulse period equal to, or shorter than, a base pulse width of the signal of serial data and with a base pulse width 1/n times that of the signal of serial data, where n is an integer. An AND operation is performed between the serial data read from the storage means and the externally provided supplementary data. For further explanation of the invention, an example is taken here in which an AND operation is performed between the serial data and a supplementary data with a pulse period equal to a base pulse width of the serial data and with a base pulse width half that of the serial data. Under these conditions, if the serial data and the supplementary data are representative a concurrent rise timing, and there are some parts in the serial data where a high level appears continuously, a rise timing and a fall timing are newly obtained at the respective boundaries of the continuous part. Thus, the rise and fall timings of the pulse signals (control signals) to be produced can be varied.

Accordingly, the arrangement is applicable in general to supplementary data with a pulse period 1/n times the base pulse width of the serial data, where n is an integer. Thus, the number of rise and fall timings can be increased to any given integer. Further, all the rise and fall timings of the pulse signal (control signal) can be uniformly shifted slightly by shifting the rise timings of the signal a1 off the rise timings of the supplementary data slightly and hence distorting the synchronism. A further alternative is supplementary data with a pulse period which is equal to a value other than 1/n times the base pulse width of the serial data, thereby producing a pulse signal (control signal) with irregularly displaced rise and fall timings.

In this manner, the arrangement allows a variety of serial-to-parallel conversions by taking advantage of timings obtained from parts of the serial data where a high level appears continuously.

As detailed in the foregoing, another signal production circuit in accordance with the present invention is arranged so that the storage means stores the single signal of serial data into which a plurality of signals of serial data representative of a plurality of sequences are merged, and the serial-to-parallel converter means decomposes the single signal of serial data into the signals of serial data, each signal representative of one of the plurality of sequences, and produces parallel data representative of the plurality of sequences from the signals of serial data.

According to the invention, a single signal of serial data is composed containing data representative of a plurality of sequences and stored in the storage means. The serial-to-parallel converter means produces parallel data representative of the plurality of sequences after decomposing the single signal of serial data into signals of serial data, each signal being intended to be representative of one of the plurality of sequences. When two signals of data for two individual sequences are combined to form a single signal of serial data so that a piece of data of one signal appears alternately with a piece of data of the other, the composed signal of serial data can be divided back into the separate signals by latching the signals independently by the use of two signals each of which rises only in the reading period of the corresponding signal. The scheme is applicable to three or more different sequences. Therefore, the invention can produce pulse signals (control signals) for a plurality of sequences without providing any additional output lines to the storage means.

As detailed in the foregoing, a display device in accordance with the present invention is arranged so that it includes one of the foregoing signal production circuits.

Therefore, the display device is cheaper and smaller, especially, in terms of area.

As detailed in the foregoing, another display device in accordance with the present invention is arranged so that it further includes display pixels which are constituted by electroluminescence elements.

According to the invention, the display pixel is constituted by an electroluminescence element; therefore, the display device is suitable for use in sequential drive whereby electroluminescence elements are charged and discharged in multiple stages.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A signal production circuit for producing, from digital data, a plurality of kinds of pulse signals which are respectively repetitions of a predetermined sequence of pulses, comprising:

storage means for storing, as the digital data, a single signal of serial data including a time series of data pulses representative of all rise and fall timings of the plurality of kinds of pulse signals and data pulses representative of all time intervals between the rise and fall timings; and serial-to-parallel converter means for reading the signal of serial data from the storage means and producing, as parallel data, the plurality of kinds of pulse signals from the data representative of all the predetermined rise and fall timings of the plurality of kinds of pulse signals.

2. The signal production circuit as defined in claim 1, wherein the serial-to-parallel converter means includes a plurality of flip-flops, connected in cascade so that an output signal of one flip-flop is an input signal of a next, which convert data from serial to parallel by sequentially latching input data based on the signal of serial data which serves as a common clock signal to all the flip-flops, and deriving output signals from predetermined ones of the plurality of flip-flops as the parallel data.

3. The signal production circuit as defined in claim 2, further comprising combining means for producing the plurality of kinds of pulse signals by combining output signals from the predetermined ones of the plurality of flip-flops.

4. The signal production circuit as defined in claim 1, further comprising control switching means for supplying the produced plurality of kinds of pulse signals to a plurality of circuits which operate in respective sequences of a common frame period, by switching from one circuit to another at the common frame period.

5. The signal production circuit as defined in claim 1, wherein the serial-to-parallel converter means performs an AND operation between the signal of serial data and data pulses with a pulse period equal to, or shorter than, a base pulse width of the signal of serial data and with a base pulse width 1/n times that of the signal of serial data, where n is an integer, before the conversion to the parallel data is performed.

6. The signal production circuit as defined in claim 1, wherein:\ the storage means stores the single signal of serial data into which a plurality of signals of serial data representative of a plurality of sequences are merged; and the serial-to-parallel converter means decomposes the single signal or serial data into the signals of serial data, each signal representative of one of the plurality of sequences, and produces parallel data representative of the plurality of sequences from the signals of serial data.

7. The signal production circuit of claim 6, wherein at least one pulse signal produced by the serial-to-parallel converter means for one sequence is overlapped in time with another pulse signal of one of said one sequence or another of the plurality of sequences.

8. The signal production circuit as defined in claim 1, wherein:

the plurality of kinds of pulse signals are used to drive matrix-type display elements in a predetermined sequence.

9. The signal production circuit as defined in claim 1, wherein:

the single signal of serial data includes a time series or data pulses each of which rises in synchronism with at least one of rise and fall timings of the plurality of kinds of pulse signals.

10. The signal production circuit of claim 1, wherein one of the plurality of pulse signals produced by the serial-to-parallel converter means is overlapped in time with another of the plurality of pulse signals produced by the serial-to-parallel converter means.

11. The signal production circuit of claim 1, wherein the serial-to-parallel converter means is configured so one of the plurality of pulse signals produced by the serial-to-parallel converter means is overlapped in time with another of the plurality of pulse signals produced by the serial-to-parallel converter means.

12. The signal production circuit of claim 1, wherein the plurality of pulse signals produced by the serial-to-parallel converter means are a plurality of control signals for controlling the operation of a device embodying the signal production circuit, and the single signal of serial data includes a time series of data pulses representative of all rises and fall timings of the plurality of control signals and data pulses of all time intervals between such rise and fall timings.

13. The signal production circuit of claim 12, wherein the serial-to-parallel converter means is arranged so as to produce the control signals from the reading of the single signal of serial data that includes a time series of data pulses representative of all rises and fall timings of the plurality of control signals and data pulses of all time intervals between such rise and fall timings.

14. The signal production circuit of claim 12, wherein the serial-to-parallel converter means comprises circuitry that is configured to read the serial data of the stored single signal and to compose and output therefrom each of the plurality of control signals embodied within the single signal of serial data.

15. The signal production circuit of claim 1, wherein the serial-to-parallel converter means comprises circuitry that is configured to read the serial data of the stored single signal and to compose and output therefrom each of the plurality of kinds of pulse signals embodied within the single signal of serial data.

16. The signal production circuit of claim 1, the wherein serial-to-parallel converter means outputs the plurality of kinds of pulse signals at the time intervals represented by the single signal of serial data.

17. A display device including a signal production circuit for producing, from digital data, a plurality of kinds of pulse signals which are respectively repetitions of a predetermined sequence of pulses, the signal production circuit comprising:

storage means for storing, as the digital data, a single signal of serial data including a time series of data pulses representative of all rise and fall timings of the plurality of kinds of pulse signals and data pulses representative of all time intervals between the rise and fall timings; and serial-to-parallel converter means for reading the signal of serial data from the storage means and producing, as parallel data, the plurality of kinds of pulse signals from the data representative of all the predetermined rise and fall timings of the plurality of kinds of pulse signals.

18. The display device as defined in claim 17, further comprising display pixels which are constituted by electroluminescence elements.

19. The display device as defined in claim 17, further comprising a matrix-type display element, wherein the signal production circuit produces, as the plurality of kinds of pulse signals, a plurality of control signals to drive the display element in a predetermined sequence.

20. The display device as defined in claim 19, further comprising a write drive circuit for sequentially applying to display pixels write voltage which is necessary for the display pixels to emit light, wherein the signal production circuit supplies plurality of first timing signals to a write drive circuit as the control signals to control an application timing of the write voltage.

21. The display device as defined in claim 19, further comprising a modulation drive circuit for applying to display pixels modulation voltage which turns on or off the display pixels according to display data, wherein the signal production circuit supplies to the modulation drive circuit a plurality of second timing signals as control signals to control timings of application of the modulation voltage.

22. The display device of claim 17, wherein one of the plurality of pulse signals produced by the serial-to-parallel converter means is overlapped in time with another of the plurality of pulse signals produced by the serial-to-parallel converter means.

23. The display device of claim 17, wherein the serial-to-parallel converter means of the signal production circuit comprises circuitry that is configured to read the serial data of the stored single signal and to compose and output therefrom each of the plurality of kinds of pulse signals embodied within the single signal of serial data.

24. The display device of claim 17, wherein the serial-to-parallel conversion circuit is configured and arranged so as to read the serial data of the stored single signal and to compose and output therefrom each of the plurality of kinds of pulse signals embodied within the single signal of serial data.

25. A signal production circuit for producing, from digital data, a plurality of kinds of pulse signals which are respectively repetitions of a predetermined sequence of pulses, comprising:

a memory for storing, as the digital data, a single signal of serial data including a time series of data pulses representative of all rise and fall timings of the plurality of kinds of pulse signals and data pulses representative of all time intervals between the rise and fall timings; and a serial-to-parallel conversion circuit for reading the signal of serial data from the memory and producing, as parallel data, the plurality of kinds of pulse signals from the data representative of all the predetermined rise and fall timings of the plurality of kinds of pulse signals.

26. The signal production circuit of claim 25, wherein the serial-to-parallel conversion circuit is configured and arranged so as to read the serial data of the stored single signal and to compose and output therefrom each of the plurality of kinds of pulse signals embodied within the single signal of serial data.

27. The signal production circuit of claim 25, wherein a serial-to-parallel conversion circuit outputs the plurality of kinds of pulse signals at the time intervals represented by the single signal of serial data.

28. A display device including a signal production circuit for producing, from digital data, a plurality of kinds of pulse signals which are respectively repetitions of a predetermined sequence of pulses, the signal production circuit comprising:

a memory for storing, as the digital data, a single signal of serial data including a time series of data poises representative of all rise and fall timings of the plurality of kinds of pulse signals and data pulses representative of all time intervals between the rise and fall timings; and a serial-to-parallel conversion circuit for reading the signal of serial data from the memory and producing, as parallel data, the plurality of kinds of pulse signals from the data representative of all the predetermined rise and fall timings of the plurality of kinds of pulse signals.

* * * * *